US007520311B2

(12) United States Patent
Drew

(10) Patent No.: US 7,520,311 B2
(45) Date of Patent: Apr. 21, 2009

(54) THREADED LIFT CORD SPOOL FOR COVERINGS FOR ARCHITECTURAL OPENINGS

(75) Inventor: Terrence M. Drew, Superior, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 249 days.

(21) Appl. No.: 11/608,939

(22) Filed: Dec. 11, 2006

(65) Prior Publication Data

US 2007/0144686 A1 Jun. 28, 2007

Related U.S. Application Data

(60) Provisional application No. 60/753,520, filed on Dec. 22, 2005.

(51) Int. Cl.
*E06B 9/30* (2006.01)

(52) U.S. Cl. ..... 160/171; 160/173 R

(58) Field of Classification Search ..... 160/84.04, 160/84.05, 170, 171, 168.1 R, 173 R; 242/397.3, 242/157.1
See application file for complete search history.

(56) References Cited

U.S. PATENT DOCUMENTS 848,239 A * 3/1907 Grimsrud ..... 242/397.3
1,281,007 A * 10/1918 Hooker ..... 242/602.1
3,129,715 A * 4/1964 Militano et al. ..... 135/20.3
3,671,016 A * 6/1972 Gladysz ..... 242/157.1
6,158,494 A 12/2000 Huang
6,918,424 B2 * 7/2005 Lin ..... 160/171
7,063,122 B2 * 6/2006 Colson et al. ..... 160/84.03
7,096,918 B2 * 8/2006 Lin ..... 160/171
7,104,492 B1 * 9/2006 Massell et al. ..... 242/397
2006/0249264 A1 * 11/2006 Lin ..... 160/171

FOREIGN PATENT DOCUMENTS

JP 63180681 * 7/1988

* cited by examiner

*Primary Examiner*—Blair M. Johnson
(74) *Attorney, Agent, or Firm*—Dorsey & Whitney LLP

(57) ABSTRACT

A system for assuring removal of a cord from its wrapping in an external thread of a spool utilizes a follower having an internal thread that moves along the spool upon rotation of the spool with the follower having a slot through which the cord is passed and a catch on the internal surface of the follower adjacent to the slot in the follower that projects into the external thread of the spool to force a removal of the cord from the thread. Preferably, the catch comprises one end of the internal thread in the follower which by its very nature projects into the external thread of the spool for engagement with a cord received in the external thread.

5 Claims, 14 Drawing Sheets

THREADED LIFT CORD SPOOL FOR COVERINGS FOR ARCHITECTURAL OPENINGS

CROSS-REFERENCE TO RELATED APPLICATION

The present application claims the benefit under 35 U.S.C. § 119(e) to U.S. Provisional Patent Application No. 60/753,520 ("the '520 application"), which was filed on Dec. 22, 2005 and entitled "THREADED LIFT CORD SPOOL FOR COVERINGS FOR ARCHITECTURAL OPENINGS." The '520 application is incorporated by reference into the present application in its entirety.

BACKGROUND OF THE INVENTION

1. Field of the Invention

The present invention relates generally to retractable coverings for architectural openings and more particularly to a spool about which a lift cord can be wrapped and unwrapped while extending and retracting the covering.

2. Description of the Relevant Art

Retractable coverings for architectural openings can assume numerous forms including retractable shades, venetian blinds, vertical blinds, cellular shades, and the like. In such coverings, a lift cord is typically utilized to move the covering between extended and retracted positions and the lift cord is sometimes wrapped around a spool, rod, or the like during a retracting movement. Lift cords can become entangled on the spool thereby inhibiting error-free operation of the covering and, accordingly, systems have been devised for discouraging entanglement of a lift cord.

One system for preventing entanglement is to provide a thread on the lift cord spool so that the cord is confined within the thread as it is wrapped about the spool and is therefore discouraged from becoming entangled. Another system for preventing entanglement consists of providing a surrounding housing to the spool which is closely spaced from the outer winding surface of the spool whereby only a single layer of cord is allowed on the spool thereby discouraging entanglement.

One cause of entanglement, when using a thread to confine the lift cord, resides in the lift cord being frictionally trapped within the thread and not being readily separated from the thread as the cord is being unwrapped from the spool and accordingly a system for assuring the removal of a lift cord from the thread of a lift spool during an extending movement of the covering would be desirable.

SUMMARY OF THE INVENTION

The present invention employs a lift system for a retractable covering for architectural openings wherein the lift cord for moving the covering between extended and retracted positions is positively controlled to prevent entanglement. The lift spool has an external thread in which the lift cord is confined and the lift cord is laid into the thread with a follower that is internally threaded and adapted to move axially along the length of the threaded spool upon rotation of the threaded spool. As the follower is moved along the threaded spool, the lift cord is fed into the thread on the spool with the lift cord being fed through a cord passage in the follower.

When the cord is removed from the external thread in the spool, as when the spool is rotated in an opposite direction, the follower moves in an opposite axial direction and the lift cord is removed through the cord passage in the follower. To prevent the lift cord from being trapped in the thread thereby causing entanglement, the internal thread on the follower has an end provided immediately adjacent to the cord passage with the end of the internal thread extending into the external thread of the spool to lift the cord out of the external thread thereby removing any possibility the cord will become trapped or hung up in the external thread as the spool is rotating causing entanglement.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
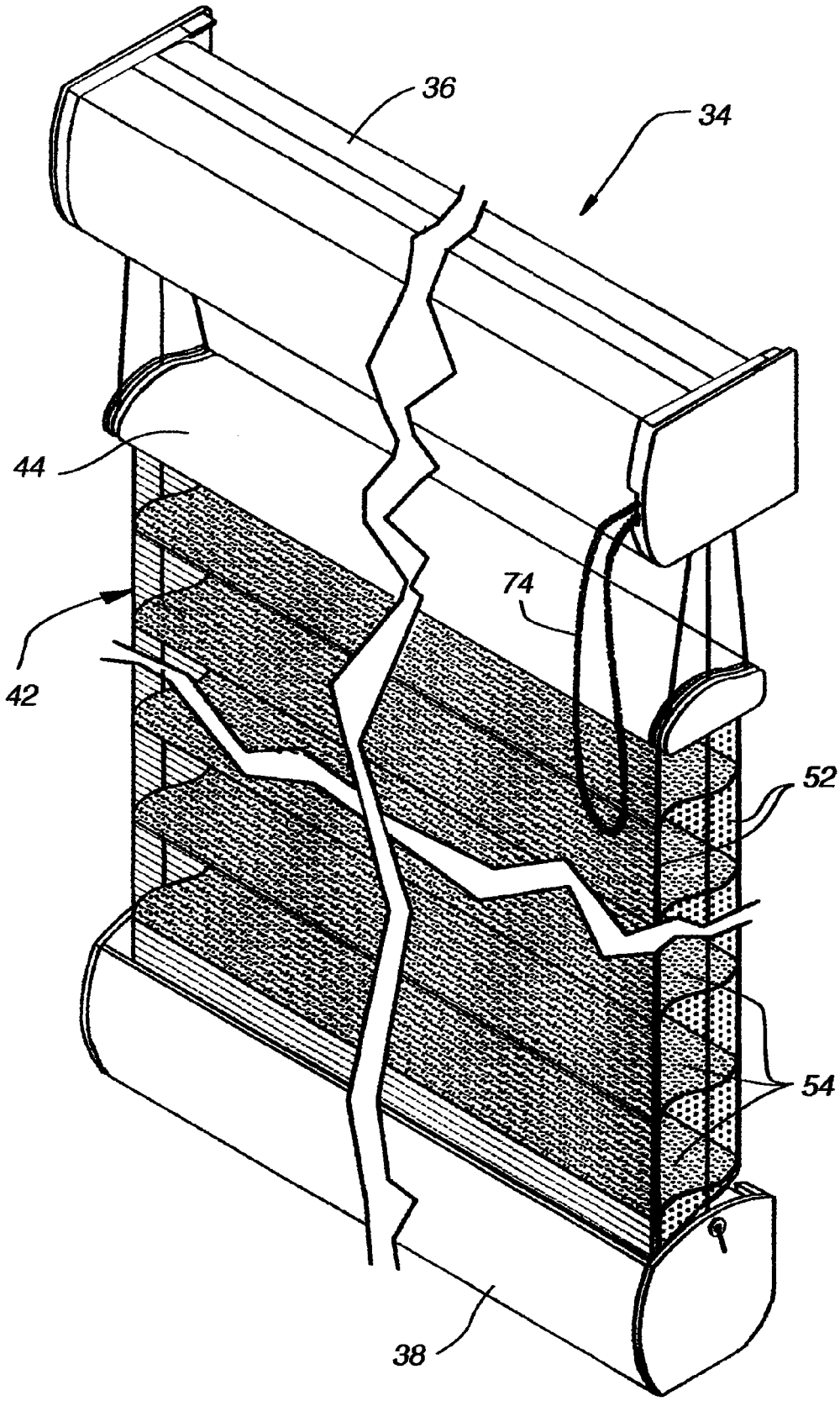
FIG. 1 is a fragmentary isometric of a retractable covering for architectural openings incorporating the lift cord control system of the present invention.

The threaded cord spool 32 of the present invention would find use in any covering for an architectural opening wherein a cord is wrapped or unwrapped about a generally cylindrical body depending upon the deployment of the architectural covering. For purposes of the present disclosure, the lift cord spool is disclosed in a top down/bottom up covering 34 of the type shown in FIGS. 1-4. The covering includes a headrail 36 in which the operative components of the shade are housed, a bottom rail 38 including a roller 40 to which the bottom of the shade material 42 is attached and about which the shade material can be wrapped, and a middle rail 44 connected to the top of the shade material. The middle rail is connected to a control system with lift cords 46*a* and 46*b* operatively associated with opposite ends of the middle rail and with the lift cords being operatively engaged with threaded lift cord spools 32 of the present invention. The bottom rail is supported by its own set of lift cords 48*a* and 48*b* which are operatively incorporated into a counterbalance system 50 also disposed in the headrail. The shade material, which could be most any flexible material, is shown for illustrative purposes as including a pair of spaced vertical flexible sheets 52 of translucent material which are interconnected by a plurality of horizontally disposed flexible vanes 54. The vanes assume a generally S-shaped transverse configuration when in the open position shown in FIG. 1 and become generally flat vertical planar sheets when the shade material is closed with the flat vanes overlapping each other. The shade material is not shown in the closed position, but a complete understanding of a covering of the general type disclosed in FIGS. 1-3 can be found in U.S. application Ser. No. 10/642,017, now U.S. Pat. No. 7,063,122, which is of common ownership with the present application and the disclosure of which is hereby incorporated by reference.

Figure 3:
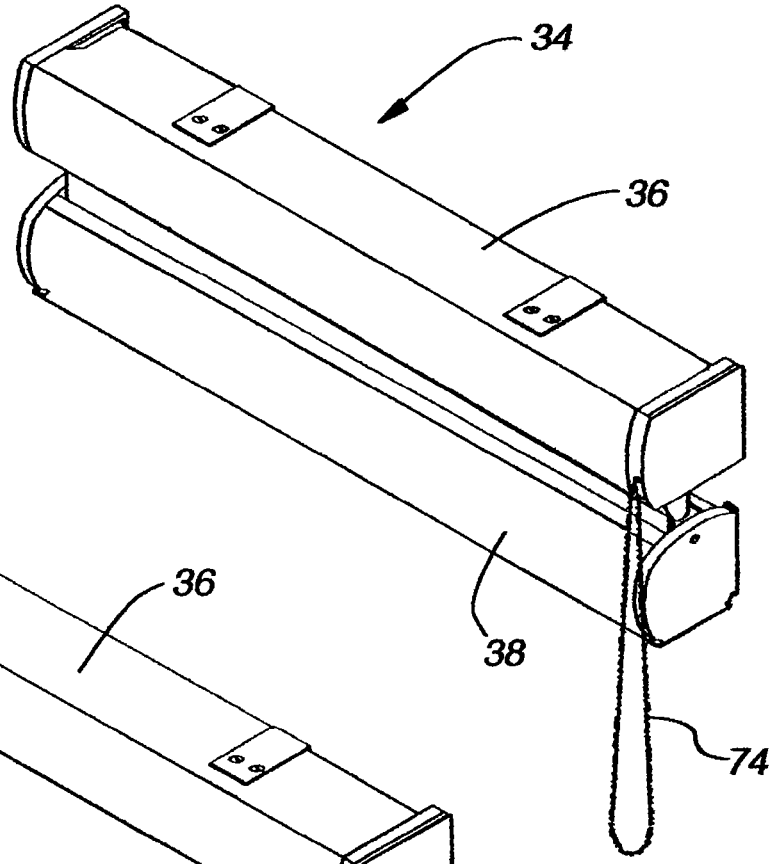
FIG. 3 is an isometric similar to FIG. 2 with the bottom rail having been raised in the covering.
Figure 2:
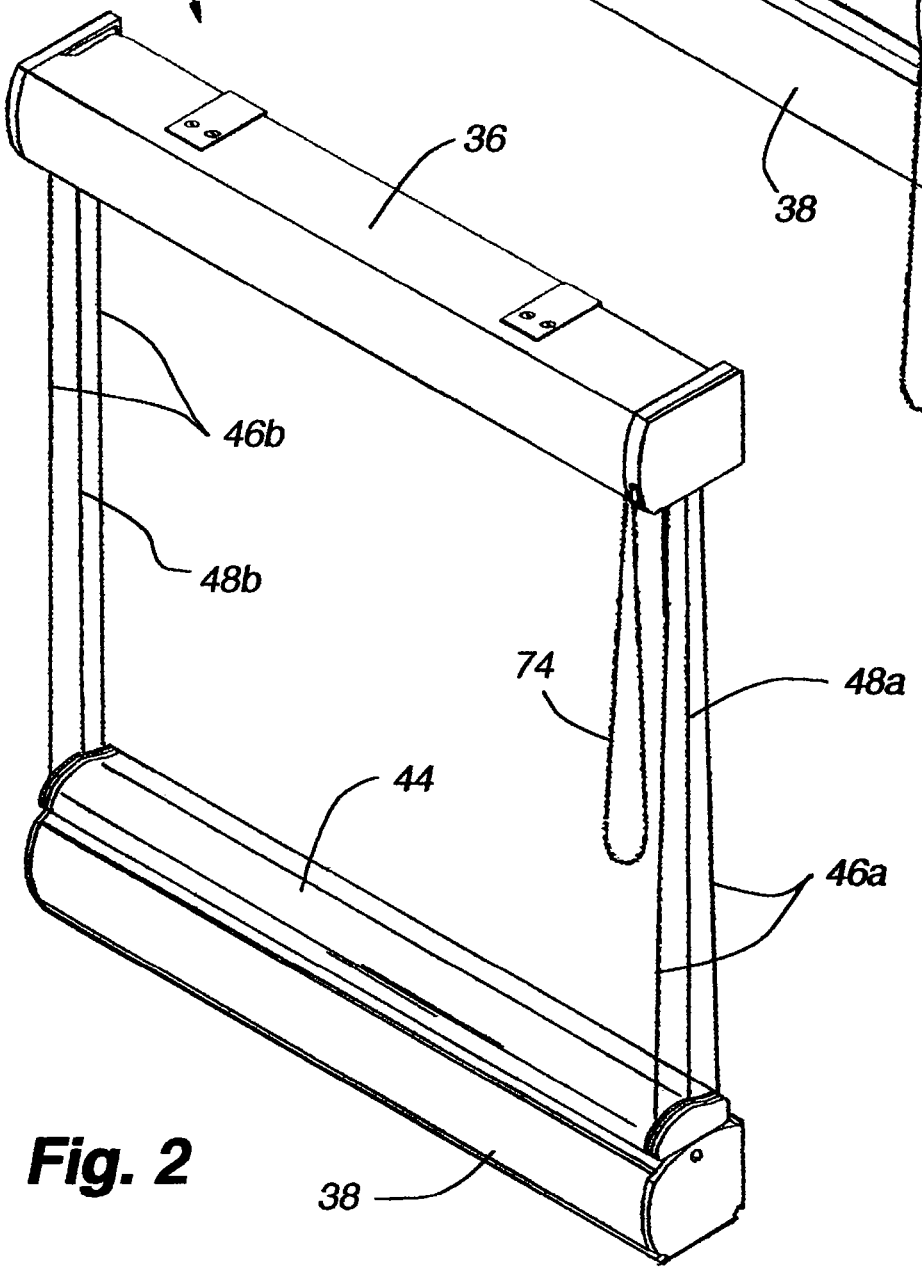
FIG. 2 is an isometric similar to FIG. 1 with the shade material having been removed and with the middle rail of the covering in a lowered position.

FIG. 2 shows the covering 34 with the middle rail 44 fully extended in adjacent relationship with the fully extended bottom rail 38 so there is no shade material 42 extending across the opening in which the covering would be mounted. FIG. 3 shows both the bottom rail and the middle rail in a retracted or raised position adjacent to the headrail 36. As will be appreciated from the generic description of the covering as being a top down/bottom up covering, the top of the shade material can be lowered or the bottom can be raised depending upon the deployment of the shade material desired.

Figure 4:
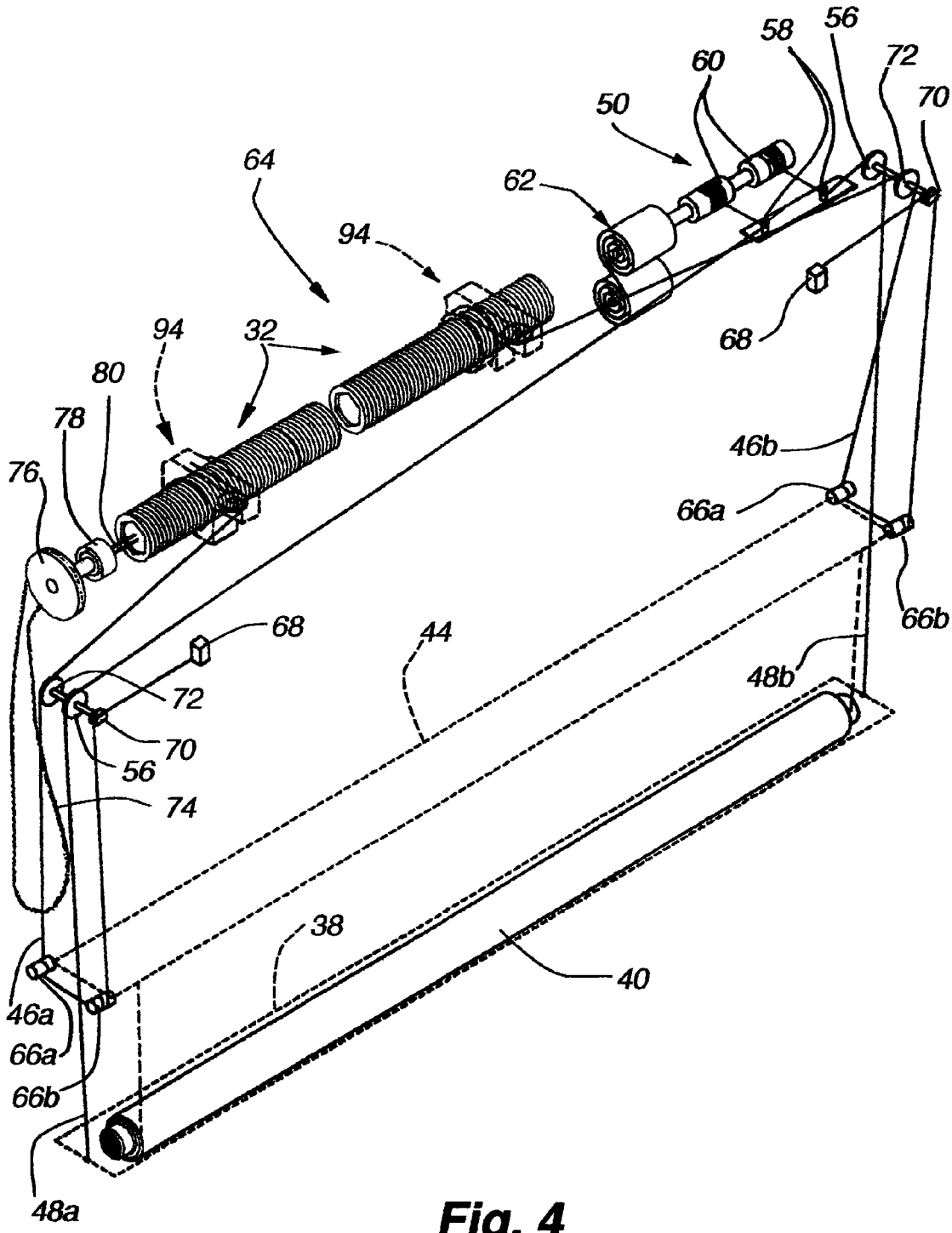
FIG. 4 is a diagrammatic isometric showing the control system of the present invention incorporated into the remainder of the covering with the shade material removed.

With reference to FIG. 4, the covering 34 of FIGS. 1-3 is shown diagrammatically and with the shade material removed. Both the middle rail 44 and bottom rail 38 are shown in phantom lines. As mentioned previously, the bottom rail is supported by lift cords 48*a* and 48*b* that are operatively associated with a counterbalance system 50 described in detail in the aforenoted U.S. Pat. No. 7,063,122. In that system a lift cord 48*a* and 48*b* is associated with each end of the bottom rail and extends upwardly around a vertical pulley 56 and then horizontally until it passes around a friction pin 58 and subsequently onto one of two rotatable spools 60. The spools are rotated in unison and are operatively associated with a constant tension spring 62 so that regardless of the direction of rotation of the spools, a constant spring bias is created sufficient to support the bottom rail. The bottom rail can therefore be manually lifted or lowered between any selected position within an architectural opening in which the covering is mounted and it will retain that position due to the counterbalance system that supports the bottom rail. Also, movement of the bottom rail relative to the middle rail causes the shade material 42 to be wrapped around or unwrapped from the roller 40 disposed within the bottom rail which is also spring biased toward a wrapped position of the shade material in a conventional manner and as described in the aforenoted U.S. Pat. No. 7,063,122.

A threaded lift cord spool system 64 including a pair of cord spools 32 is utilized in controlling the lift cords 46*a* and 46*b* associated with the middle rail 44 and as will be appreciated by reference to FIG. 4, there are two threaded lift spools 32 with one having a right-hand thread and the other a left-hand thread. Otherwise the spools are identical. The two spools are utilized in the covering 34 disclosed in the present application but it should be understood the concept of the present invention is applicable to any threaded spool and more specifically to a system for controlling the wrapping and unwrapping of a cord about a threaded spool.

In general, each threaded spool 32 is associated with a lift cord 46*a* and 46*b* that is in turn associated with one end of the middle rail 44. The middle rail has first and second spaced axially extending friction pins 66*a* and 66*b* respectively at each end thereof and an anchor 68 is provided within the headrail for anchoring one end of each lift cord. The lift cord associated with each threaded spool extends from its associated anchor 68 in a horizontal direction around an arcuate block 70 and from the block vertically downwardly where it is wrapped around the second friction pin 66*b* adjacent one longitudinal edge of the middle rail and subsequently around the first friction pin 66*a* adjacent the opposite longitudinal edge of the middle rail before extending upwardly and passing around a pulley 72 from which it extends generally horizontally to the associated threaded spool 32. As will be described in more detail later, the lift cord is wound onto the threaded spool or unwound from the spool depending upon whether or not the middle rail is raised or lowered respectively and the threaded spools are manually rotatably driven by an endless drive cord 74 at one end of the covering. The endless drive cord extends around a drive wheel 76 that is in turn operatively connected to the lift spools 32 through a two-way clutch 78 so that rotation of the drive wheel in either direction by the drive cord will rotate a drive shaft 80 associated with the threaded spools. The two-way clutch, however, allows the threaded spools to remain in any position in which they are moved until the drive wheel is again rotated by the drive cord. Again, this system as thus far described is disclosed in detail in the aforenoted U.S. Pat. No. 7,063,122.

It will be appreciated from the above that by rotating the drive wheel 76 with the drive cord 74, the middle rail 44 can be raised or lowered depending upon the direction of rotation of the drive wheel. By manually lifting or lowering the bottom rail 38, it can be moved between any selected position through its operative connection with the counterbalance system 50. Accordingly, the shade material 42 can be extended to any desired degree between the middle rail and the bottom rail and positioned at any desired location between the headrail 36 and the fully extended position of the bottom rail 38.

As is also described in detail in the aforenoted U.S. Pat. No. 7,063,122, when the drive cord 74 rotates the drive wheel 76 in a direction causing the lift cords 46*a* and 46*b* to be wrapped onto their associated threaded spools 32, the tension placed in the lift cord between the spool and the first friction pin 66*a* directly associated therewith causes the lift cord to grip the first friction pin thereby lifting the associated edge of the middle rail 44 relative to the opposite edge of the middle rail which pivots the middle rail about a longitudinal axis, and consequently the connected flexible vanes 54 in the shade material 42, between the open position of FIG. 1 and a closed position (not shown) wherein the vanes are substantially vertically oriented in a flat planar configuration and slightly overlapped with each other. When the lift cords are unwrapped from the associated threaded spools due to rotation of the drive wheel in an opposite direction, the first friction pin 66*a*, directly associated with the lift cord as it emanates from the threaded spool, is initially lowered until it becomes horizontally aligned with the second friction pin 66*b* so that when the middle rail is thereby pivoted, the slats in the shade material are pivoted correspondingly to the open position of FIG. 1.

The components of the threaded lift cord spool system 64 of the present invention are possibly shown best in FIG. 5 where again it will be appreciated there are two lift cord spools 32 with one having an external left-hand thread 82 and the other an external right-hand thread 82 on a cylindrical body. The spools are otherwise identical. Each spool has hexagonal openings 84 in its opposite ends for receipt of end plugs 86 that include a cylindrical body 88 insertable into the associated end of the threaded spool and a hexagonal head 90 that fits frictionally into the hexagonal opening at the associated end of the spool. As will be described in more detail later, each spool also has a radial slot 92 at one end extending from the external thread 82 to the hexagonal opening in that end.

A generally L-shaped follower 94 is associated with each threaded spool 32 and has a cylindrical passage 96 therethrough with an internal thread 98 adapted to mate with the external thread 82 on the associated spool. The followers are adapted to move axially along the length of their associated threaded spools upon rotation of the threaded spools and due to the opposite threads on the threaded spools, unitary rotation of the spools in one direction causes the followers to move toward each other and in the opposite direction causes the followers to move away from each other. The followers will be described in detail later but suffice it to say each follower has a cylindrical skirt 100 with an elongated, diagonal, arcuate cord slot 102 formed in the top surface thereof and with the slot being angled relative to the axis of the cylindrical skirt so as to be aligned with the thread on the underlying spool.

Figure 5:
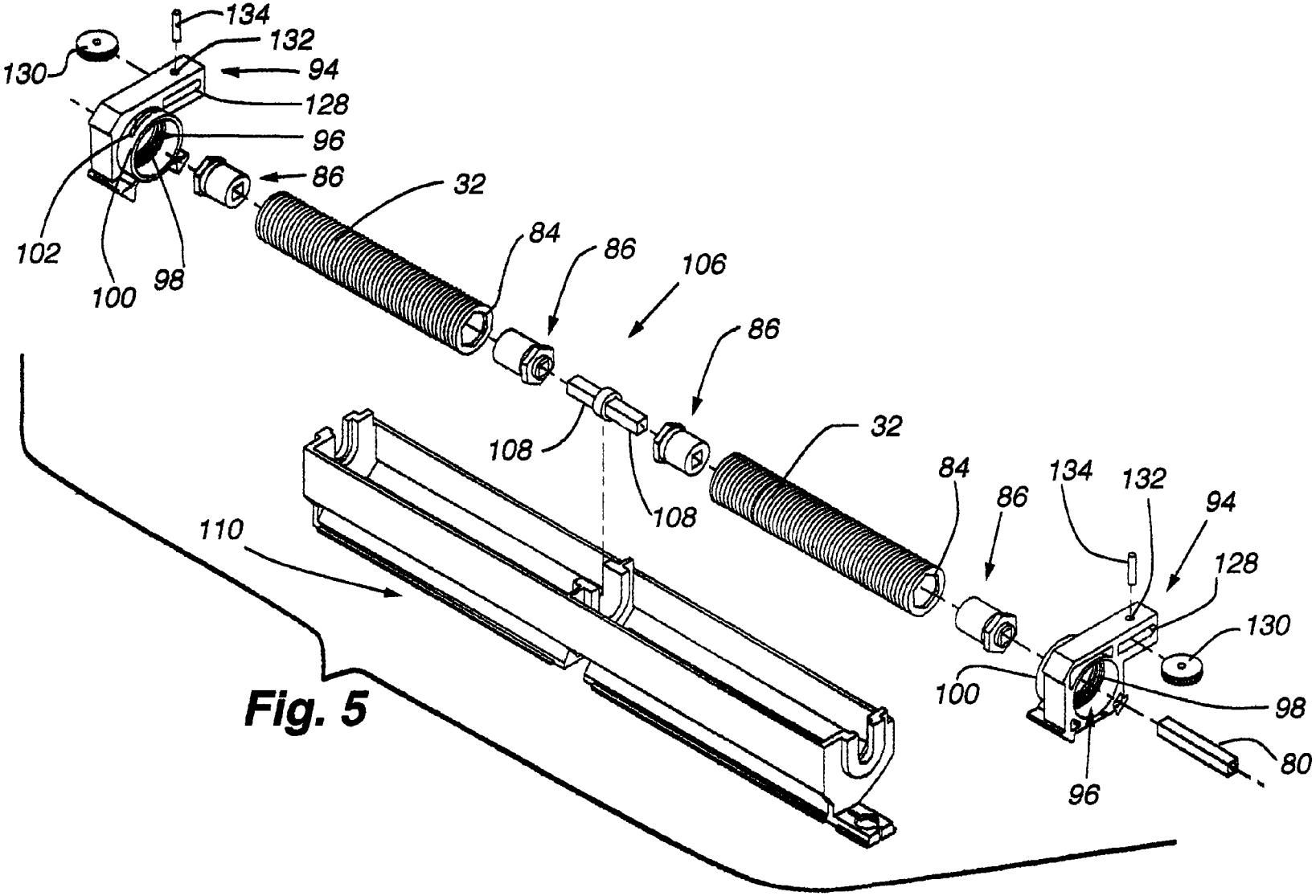
FIG. 5 is an exploded isometric of the lift cord control system of the invention.

Each end plug 86 has a square passage 104 therethrough with the proximal end plugs at the adjacent ends of the threaded spools 32 receiving a dual axle connector 106 having a pair of axles 108 of square cross section extending in opposition directions so that the threaded spools rotate uniformly and in unison. The square passage in the end cap at the opposite or distal end of one threaded spool (the right threaded spool as seen in FIG. 5), is adapted to receive the square drive shaft 80 which is driven by the two-way clutch 78 described previously. In other words, it will be appreciated that by rotation of the drive wheel 76, the square drive shaft will rotate both threaded spools in the same direction causing the followers 94 to move toward or away from each other depending upon the direction of rotation of the square drive shaft.

As will be described in more detail later, the threaded spools 32 and the shaft 80 and axles 108 upon which they are mounted, as well as the followers 94, are confined within a generally U-shaped elongated housing 110 and the followers are slidably confined within the housing so they cannot rotate relative to the housing while the threaded spools on which they are mounted are rotated with the square drive shaft 80. This arrangement assures uniform movement of each follower along its associated threaded spool upon rotation of the threaded spool.

Figures 7, 8, 9:
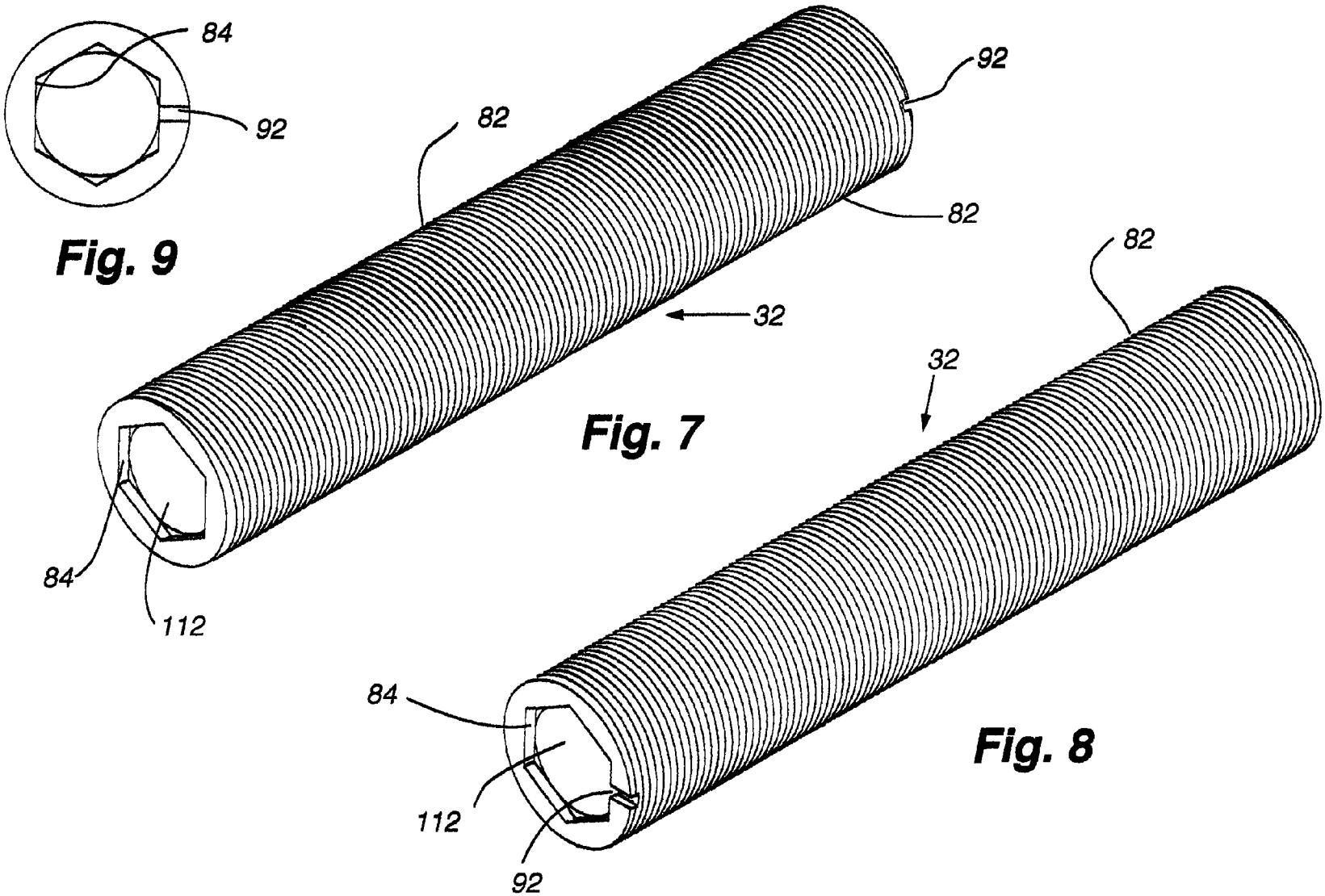
FIG. 7 is an isometric looking downwardly on the threaded spool in a first direction.
FIG. 8 is an isometric looking downwardly on the threaded spool from an opposite direction.
FIG. 9 is an end elevation looking at the left end of the spool as shown in FIG. 8.
Figure 10:
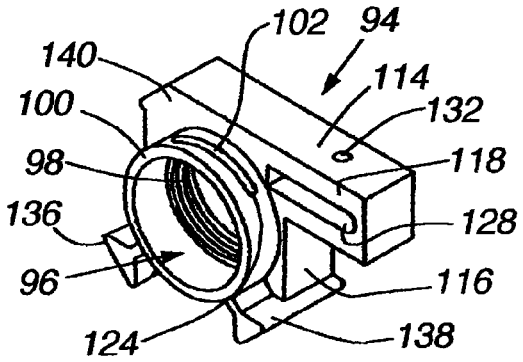
FIG. 10 is an isometric looking downwardly on a follower used with a threaded spool in accordance with the present invention.
Figure 11:
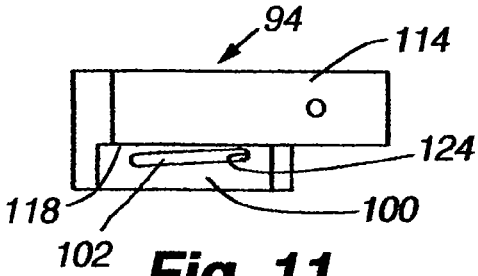
FIG. 11 is a top plan view of the follower of FIG. 10.
Figure 12:
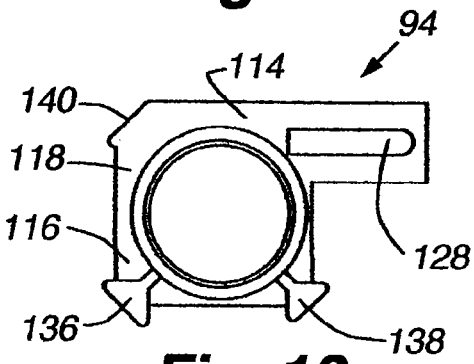
FIG. 12 is a front elevation of the follower of FIG. 10.
Figure 13:
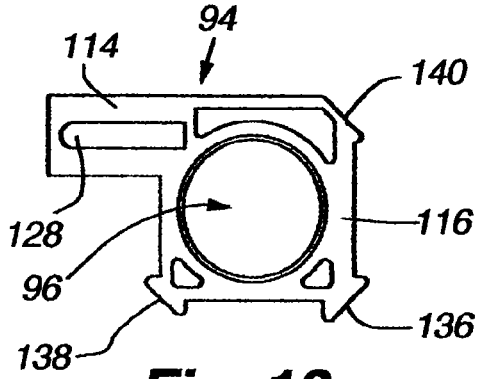
FIG. 13 is a rear elevation of the follower of FIG. 10.
Figure 14:
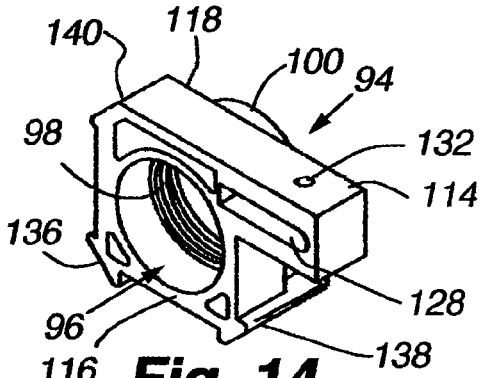
FIG. 14 is an isometric looking at the rear side of the follower used on a second threaded spool for the lift system of the present invention.
Figure 15:
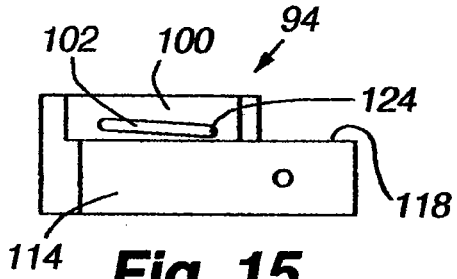
FIG. 15 is a top plan view of the follower shown in FIG. 14.
Figure 16:
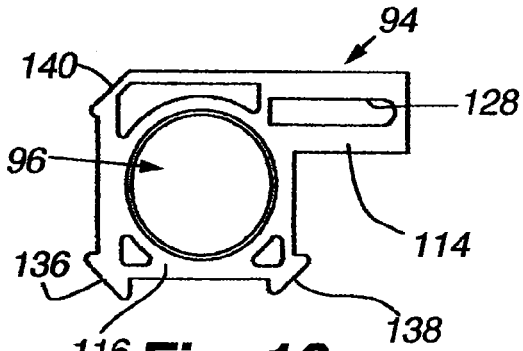
FIG. 16 is a front elevation of the follower shown in FIG. 14.
Figure 17:
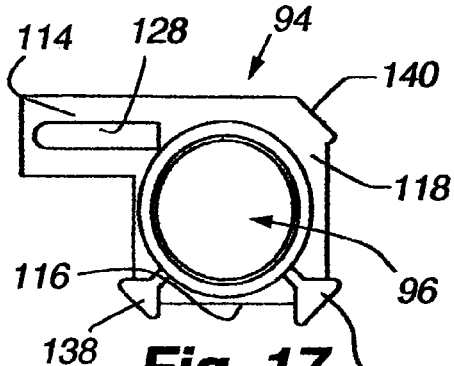
FIG. 17 is a rear elevation of the follower shown in FIG. 14.

FIGS. 7, 8 and 9 show a threaded spool 32 as above described wherein the spool has either a left or right-hand thread 82, the hexagonal opening 84 in each end, a cylindrical inner surface 112 and a cylindrical outer surface in which the external thread is formed. The radial slot 92 at one end of the spool is seen in FIGS. 8 and 9 to extend from the external thread 82 of the spool to the internal cylindrical surface 112.

Figure 28:
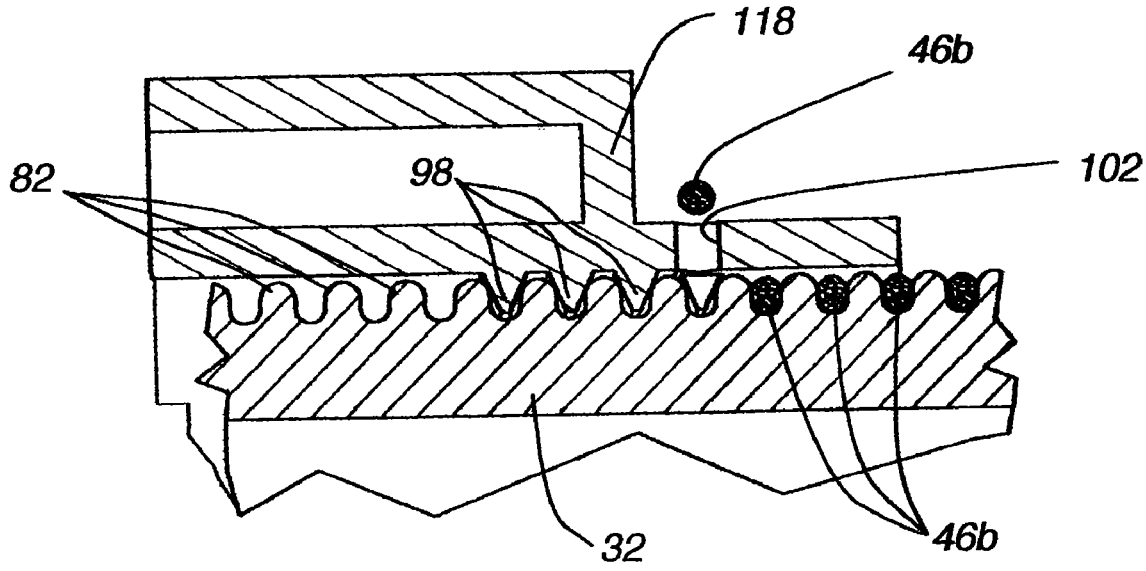
FIG. 28 is an enlarged section taken along line 28-28 of FIG. 27.

The two followers 94 are mirror images of each other with one follower illustrated in FIGS. 10-13 and the other in FIGS. 14-17. Each follower has a horizontal upper leg 114 and a vertical lower leg 116 with the cylindrical skirt 100 and passage 96 extending through the vertical lower leg and the skirt. The internal thread 98 in the follower, as possibly best seen in FIG. 28, commences inwardly of a flat front wall or surface 118 of the follower and extends to an end location 120 just past the front surface or wall 118 of the upper leg so as to be in alignment with the rearwardmost end 124 of the lift cord slot 102. The internal thread therefore has two ends with one end 126, the rearmost end, being positioned inwardly of the flat front wall or surface 118 of the follower and the other end 120, the forwardmost end, at a location commensurate with the rearwardmost end 124 of the lift cord slot 102, i.e. the end closest to the front wall 118 of the upper leg.

Figure 6:
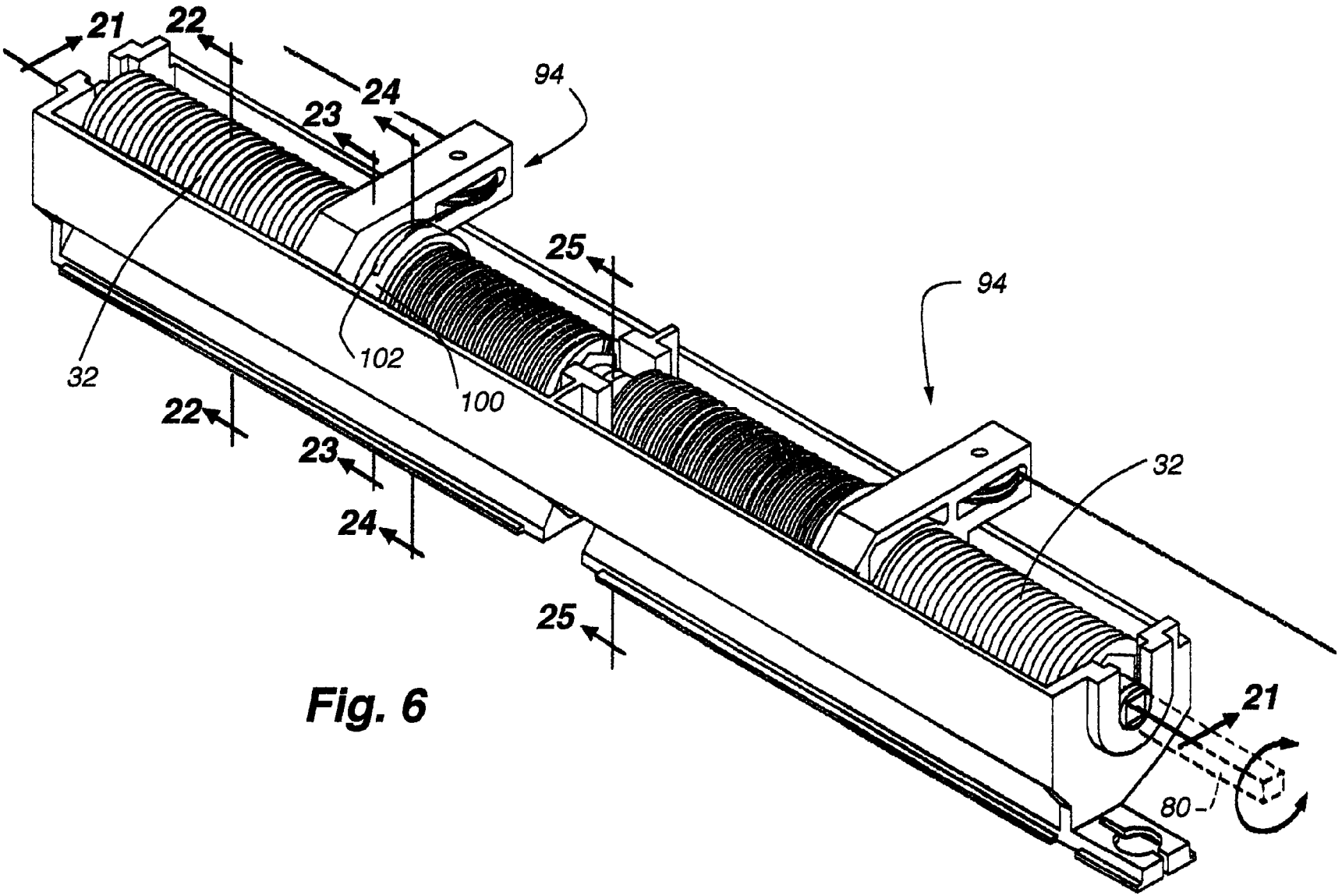
FIG. 6 is an isometric similar to FIG. 5 with the components of the lift cord control system integrated.

The upper leg 114 also has a horizontal passage 128 formed therein in which a pulley 130 is adapted to be mounted. A vertical hole 132 passes downwardly through the upper leg and the passage to receive a pivot pin 134 for the pulley. The pulley can be seen for example in FIG. 6. The lower or vertical leg 116 of each follower has three flattened tabular corners, two 136 and 138 along its bottom and one 140 at its top, that cooperate with corresponding walls of the housing, as will be appreciated hereinafter, to prevent rotation of the follower relative to the housing. As mentioned previously, since the followers 94 are mirror images of each other, the skirt on one follower will confront the skirt 100 on the other follower and the front faces 122 of the followers will face in opposite directions when the followers are threadedly mounted on their associated spools.

Figure 18:
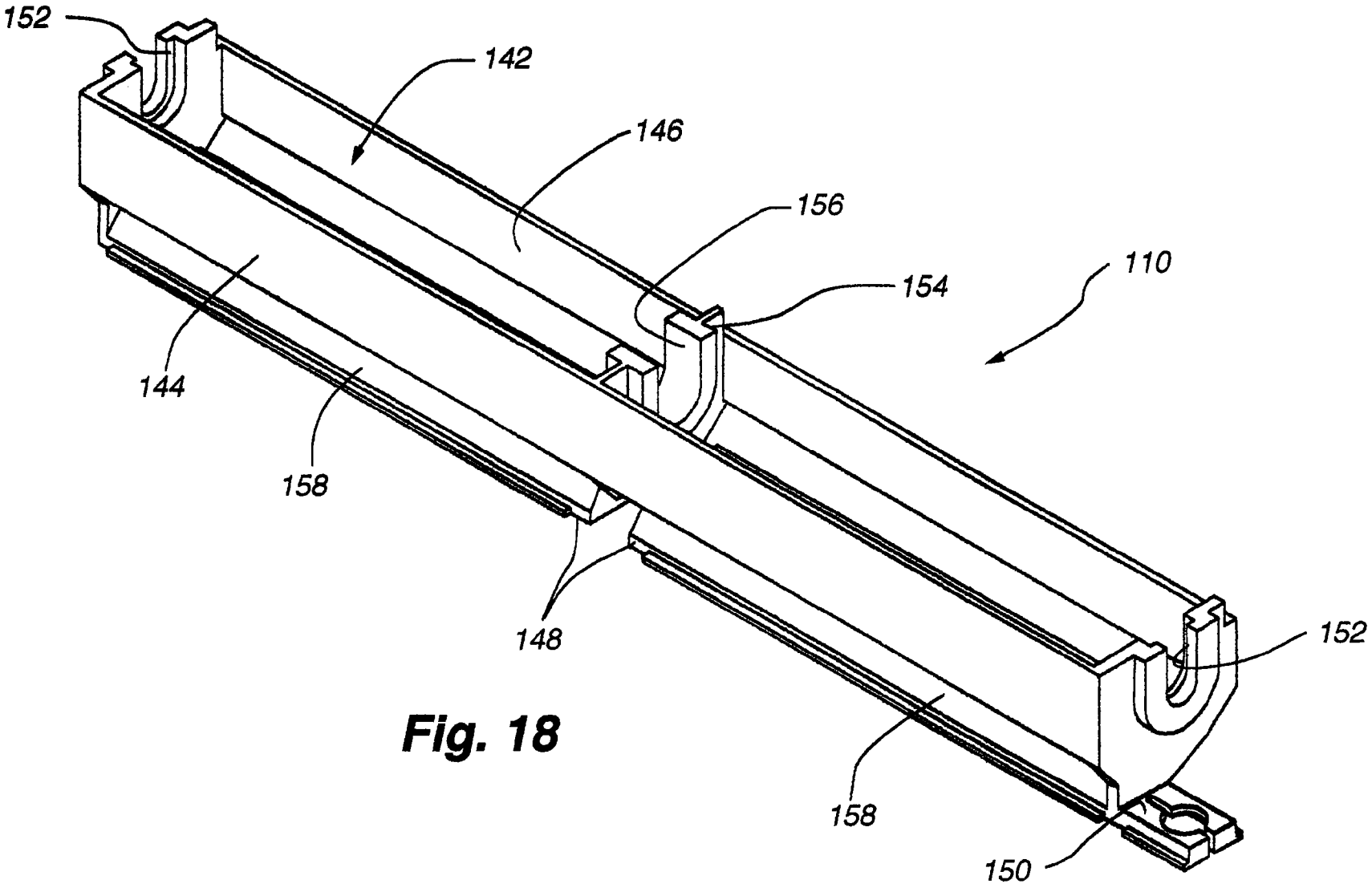
FIG. 18 is an isometric of the housing for the lift system of the present invention.
Figure 24:
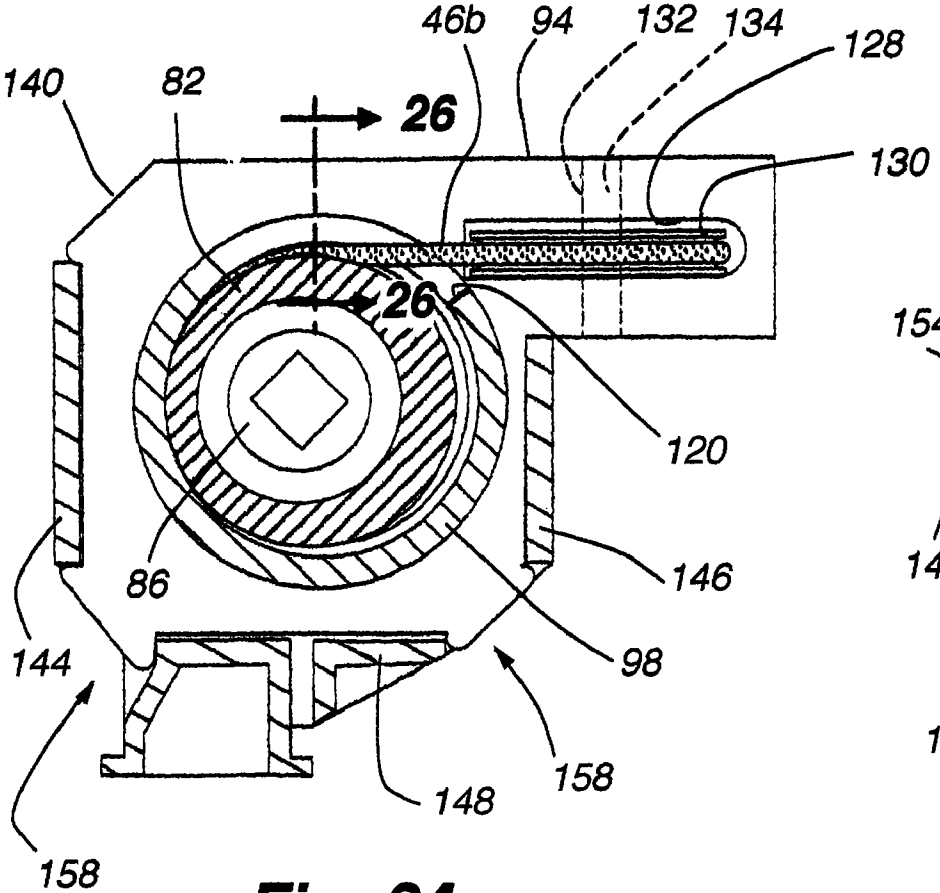
FIG. 24 is an enlarged section taken along line 24-24 of FIG. 6.
Figure 26:
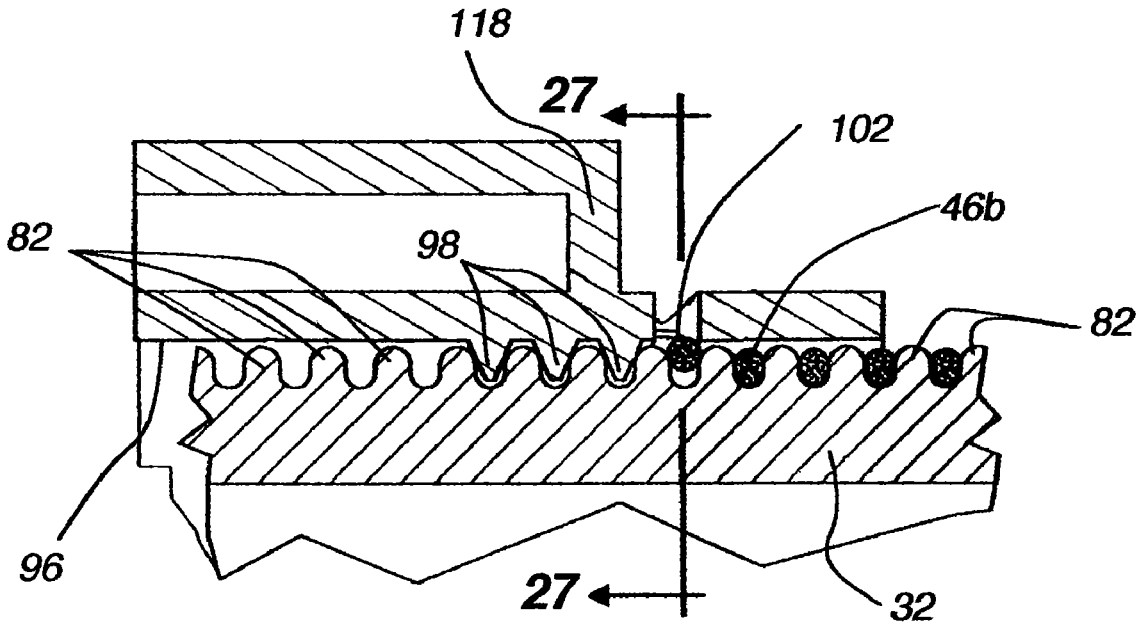
FIG. 26 is an enlarged section taken along line 26-26 of FIG. 24.

With reference to FIG. 18, the elongated housing 110, as mentioned previously, is generally U-shaped in configuration having an open upper top 142, a front wall 144, a rear wall 146, and a bottom wall 148. The bottom wall has longitudinally extending tabs 150 for anchoring the housing to the headrail 36 of the covering 34 for the architectural opening. Each end of the housing has a U-shaped bearing surface 152 and a divider 154 at the midpoint of the length of the housing which also defines a U-shaped bearing surface 156 for rotatably supporting the end plugs 86 and the dual axle connector 106 respectively. As may possibly best be appreciated by reference to FIG. 24, the front 144 and rear 146 walls of the housing are spaced from the bottom wall so as to define angled gaps 158 therebetween for receipt of the two lower flat tabular corners 136 and 138 of the followers 94 so that the followers are prohibited from rotating within the housing. The third flat tabular corner 140 at the top of the vertical leg of the follower overlies the front wall 144 for the same purpose. It will be appreciated, however, that the follower is allowed to slide along the length of the housing upon rotation of the lift spool 32 upon which it is threadably mounted.

Figure 20:
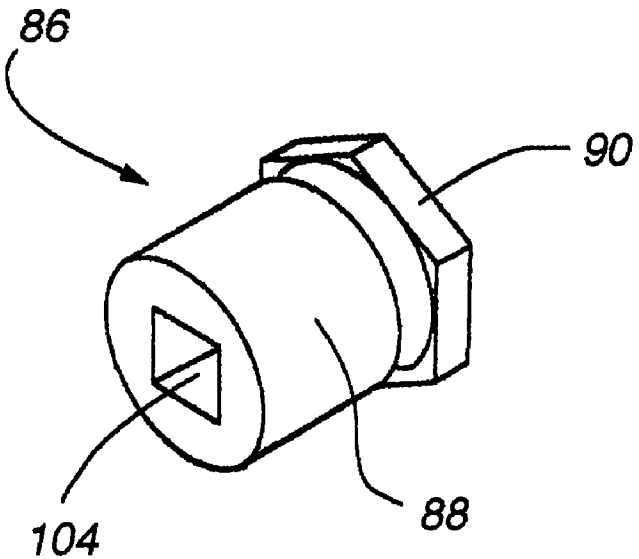
FIG. 20 is an isometric looking at the opposite end of the spool as shown in FIG. 19.
Figure 19:
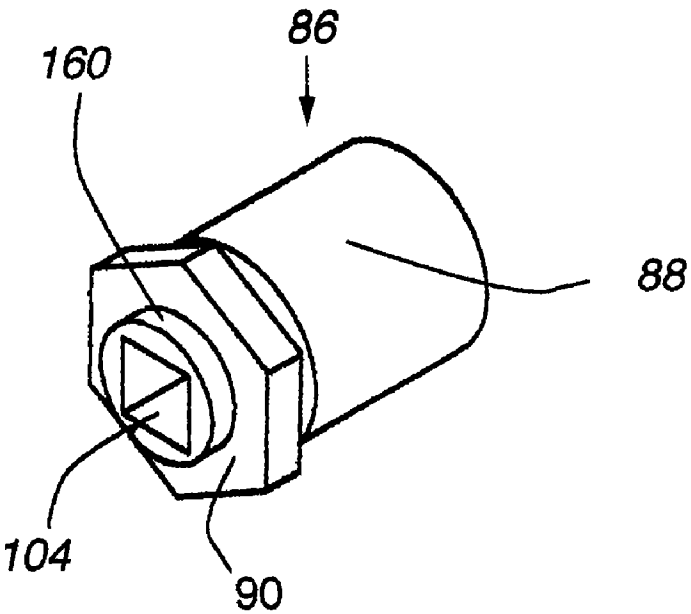
FIG. 19 is an isometric looking at one end of an end plug for a threaded spool of the lift system of the invention.
Figure 21:
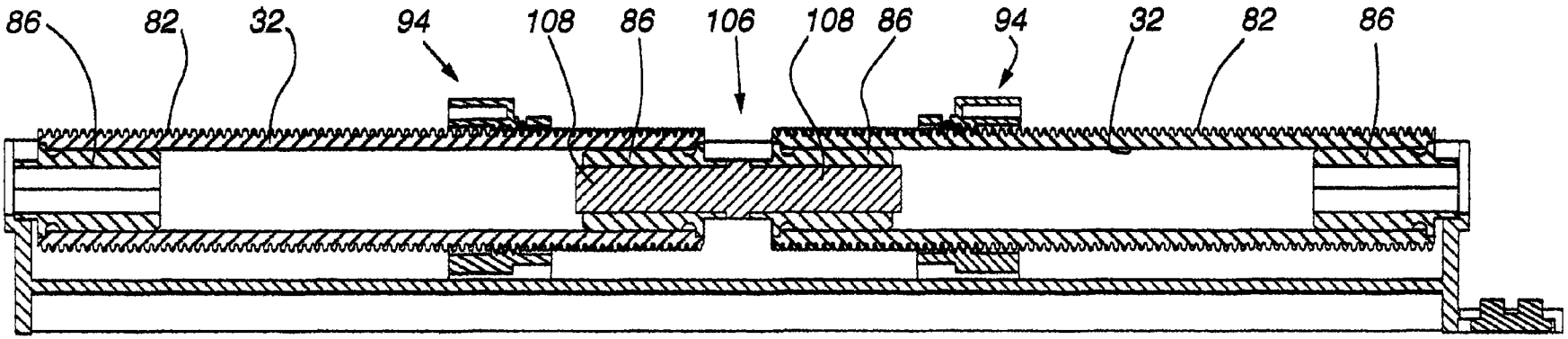
FIG. 21 is a section taken along line 21-21 of FIG. 6.
Figure 23:
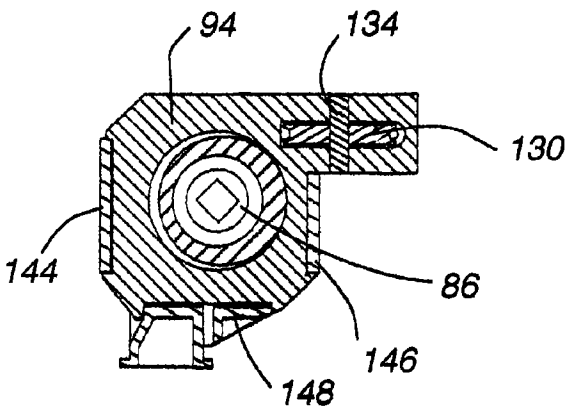
FIG. 23 is a section taken along line 23-23 of FIG. 6.
Figure 22:
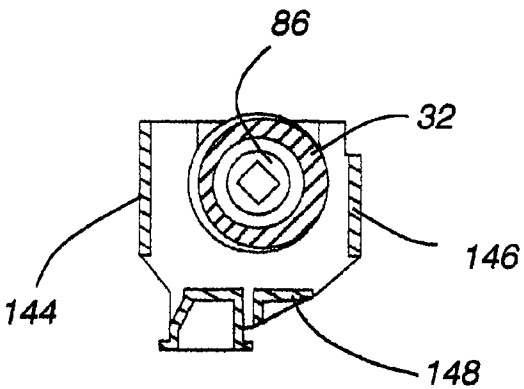
FIG. 22 is a section taken along line 22-22 of FIG. 6.
Figure 25:
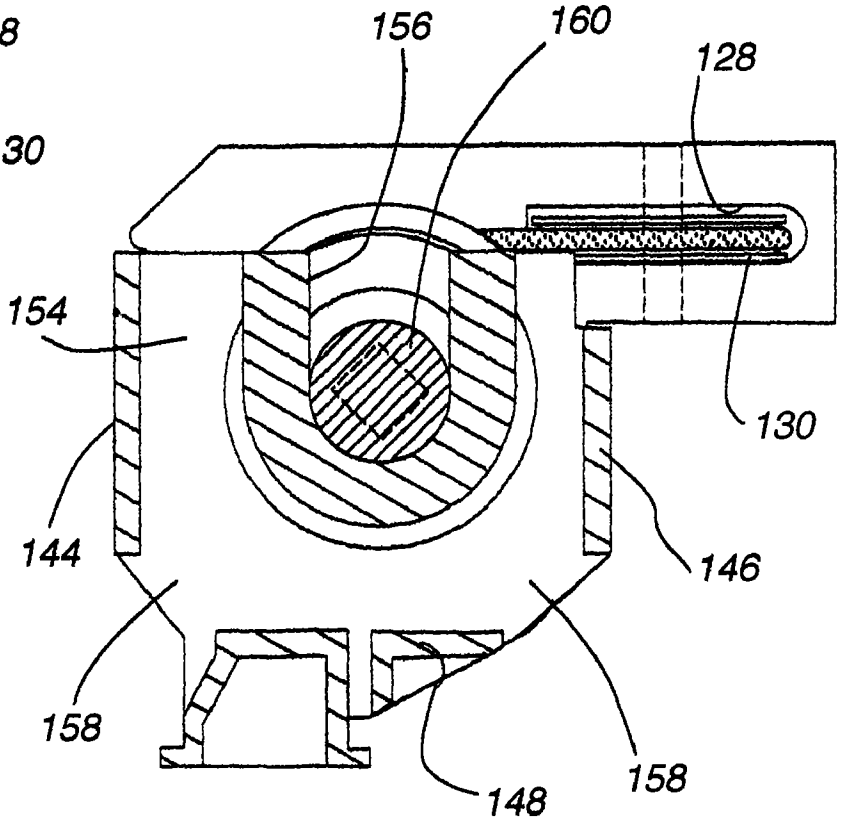
FIG. 25 is an enlarged section taken along line 25-25 of FIG. 6.

The end plugs 86 are all identical and are illustrated in FIGS. 19 and 20. As mentioned previously, they include the cylindrical body 88 with the hexagonal head 90 and a hollow axle 160 protrudes axially from the hexagonal head to be rotatably seated on a U-shaped bearing surface 152 or 156 of the housing. The square passage 104 through the end plug is adapted to receive either the square drive shaft 80 or the dual shaft connector 106 so that the end plugs and consequently the threaded spools are rotated in unison with the drive shaft.

FIGS. 6 and 21-23 show the aforenoted components of the threaded lift cord spool system 64 integrated and in operative relationship with each other. As will be appreciated, and as was mentioned previously, one end of each lift cord 46*a* and 46*b* is secured to an anchor block 68 in the headrail 36 and the opposite end is secured to an associated spool 32. The end of the cord secured to the spool is connected by passing it through the radial slot 92 provided in the proximal end of the spool and the cord is held in position by thereafter inserting an end plug 86 into the end of the spool which becomes frictionally retained within the end of the spool with the cord and rotates with the spool due to the cooperation of the hexagonal head 90 of the end plug with the hexagonal opening 84 in the end of the spool. As the lift cord radiates outwardly through the radial slot in the end of the spool, it is fed into the external thread 82 of the spool and subsequently through the diagonal cord slot 102 in the skirt 100 of the associated follower. It thereby extends out of the cord slot and then around the pulley 130 on the follower before extending to the middle rail 44 and ultimately the anchor block 68 at its opposite end.

As will be appreciated, as the threaded spools 32 are rotated in one direction, the lift cords 46*a* and 46*b* are either laid into the external threads 82 through the cord slots 102 in the skirts or removed from the threads when the spools are rotated in the opposite direction. In the disclosed embodiment, one direction of rotation, as when the followers move away from each other, causes the cords to be laid in the spools and the middle rail to be raised. The opposite direction of rotation causes the followers to be moved toward each other removing the cords from the spools and allowing the middle rail to be lowered. Further, the internal thread on the follower and the external thread on the spool are obviously the same, allowing the lift cord to be carefully and controllably laid into the external thread in a continuous manner when the spool is rotated in one direction. When the spool is rotated in the opposite direction, the weight of the middle rail 44 which creates a tension in the lift cord, causes the lift cord to be lifted from the external thread again in a controlled manner as the follower 94 is moved along the threaded spool.

Figure 27:
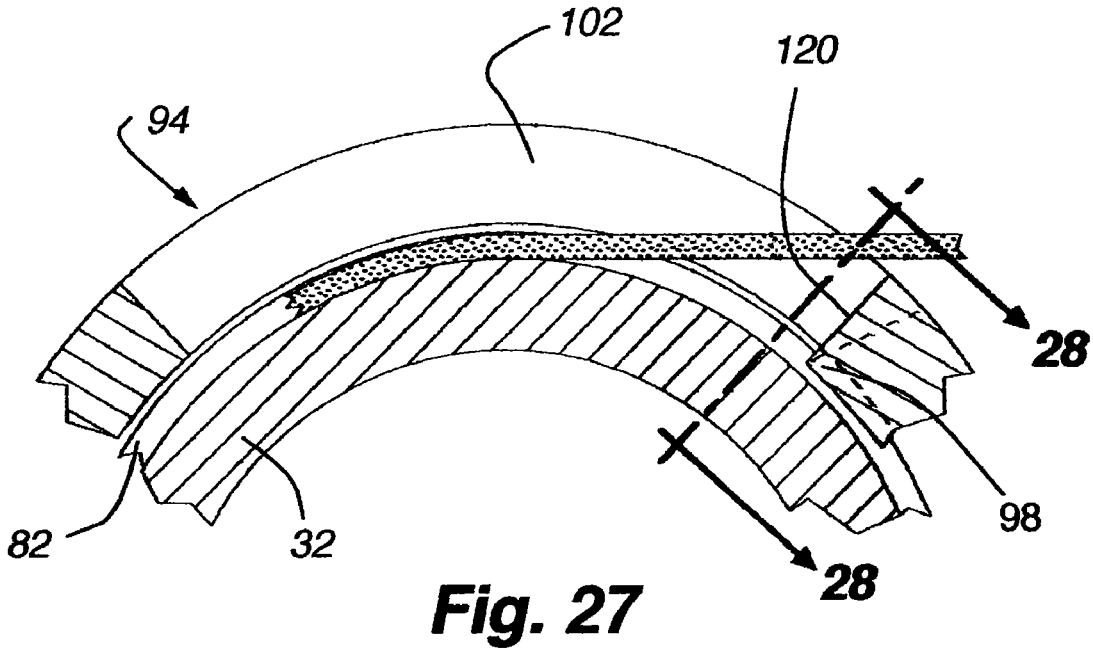
FIG. 27 is a section taken along line 27-27 of FIG. 26.
Figure 29:
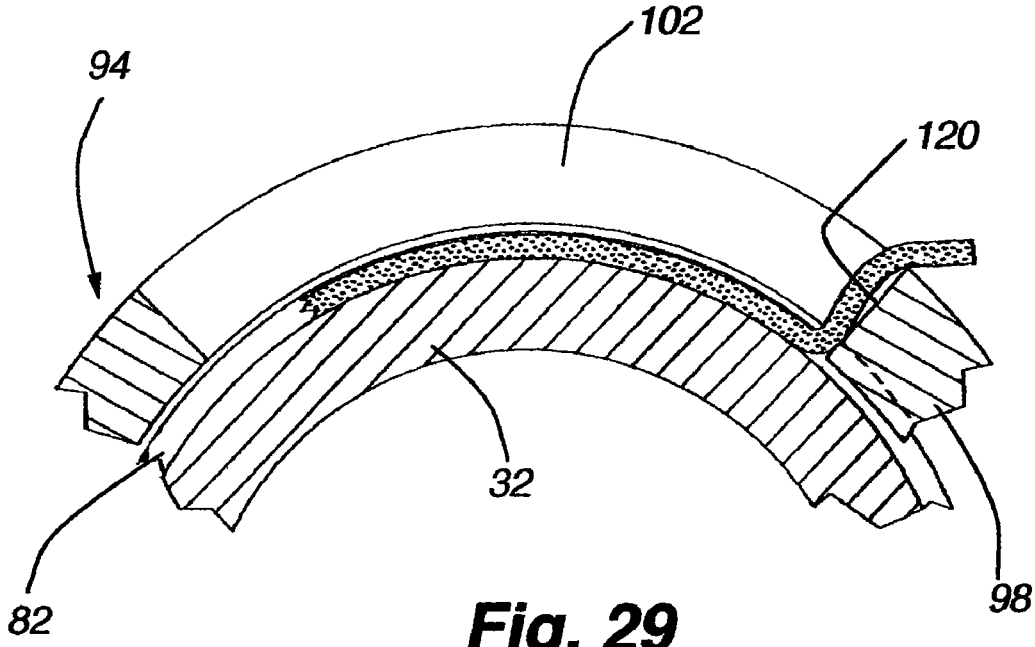
FIG. 29 is a section similar to FIG. 27 with the lift cord spool having been rotated in a clockwise direction approximately 30 degrees with the catch thread of the follower engaging the lift cord.
Figure 30:
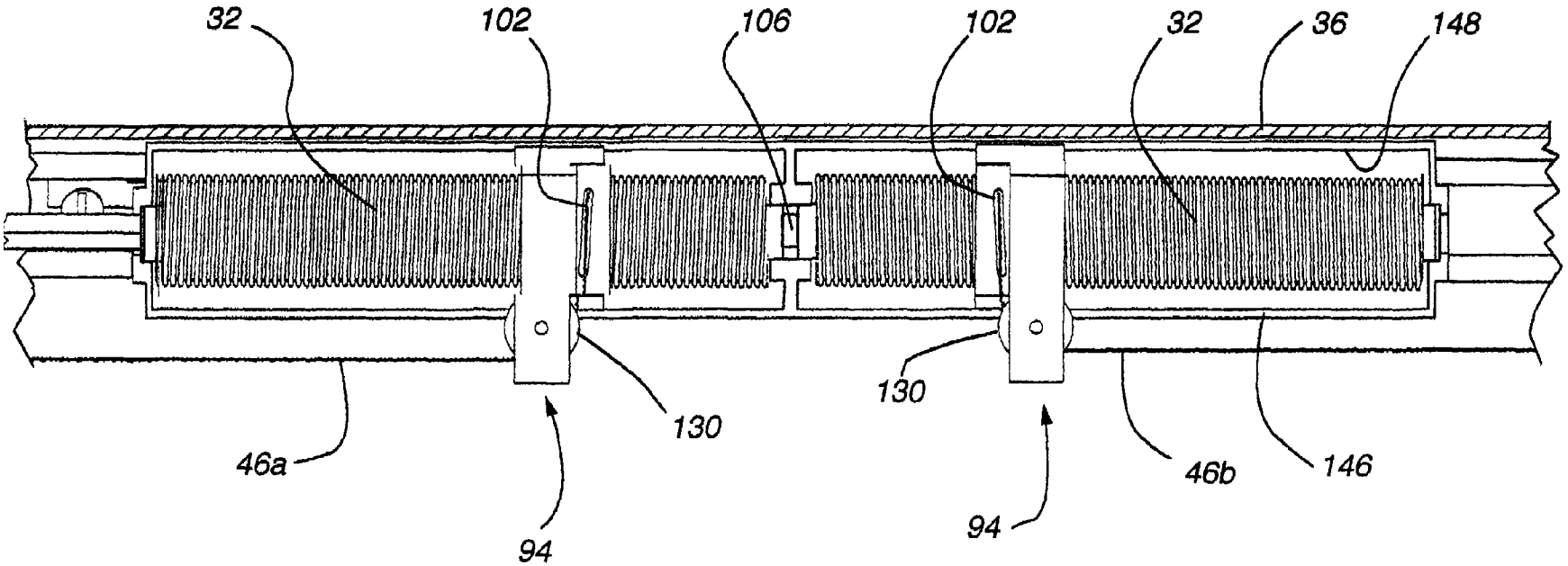
FIG. 30 is a top plan view of the lift system of the present invention.

As mentioned previously, and as possibly best appreciated by reference to FIGS. 26-29, the forewardmost end 120 of the internal thread 98 of the follower that terminates adjacent to the rearwardmost end 124 of the cord slot 102 in the skirt 100 of the follower has its termination location closely adjacent to or contiguous with the rearwardmost end of the slot. Accordingly, if during an unwinding movement of the spool, the lift cord does not easily lift out of the external thread 82 of the spool in which it is wound, the forwardmost end 120 of the internal thread as seen in FIG. 29 will engage the lift cord and force it out of the external thread of the spool. If the forwardmost end of the internal thread were not so positioned, the lift cord might remain within the external thread of the spool passing beyond the cord slot in the skirt of the follower and become entangled within the system. As best appreciated by reference to FIG. 29, however, the interrelationship of the internal and external threads do not provide enough space for the lift cord to get therebetween and, accordingly, it is forced out of the external thread and through the cord slot in the follower for reliable operation. It should also be noted that the end 120 of the internal thread is shown as a radical surface relative to the cylindrical passage 96 that the surface could be inclined at an acute angle relative to the radical orientation illustrated so as to provide some lift should the surface engage the cord. An acute angle in the range of 5° to 15° has been found useful but not mandatory. An inclined alternative surface is illustrated in FIG. 27 in dashed lines.

It will be appreciated from the above a system has been disclosed for controlling the wrapping and unwrapping of a cord from a threaded spool by utilization of a follower having an internal thread mated with the external thread of the spool for movement along the length of the spool. By removing the cord from the external thread through a slot in the follower at a location immediately adjacent or contiguous with an end of the internal thread of the follower, the cord is forcibly removed from the external thread of the spool.

It will be appreciated, however, that the end 120 of the thread would not necessarily need to be used for forcing the cord out of the thread but rather a separate catch or thread follower (not shown) could be incorporated into the follower with the internal thread of the follower actually terminating before the cord slot in the follower. Such a catch or thread follower would of course project into the external thread 82 of the lift spool 32 immediately adjacent to the cord slot 102 in the follower so as to function similarly to the first described system. The most convenient system, however, is felt to employ the internal thread 98 of the follower itself for making sure the cord is lifted from the external thread 82 of the spool.

Although the present invention has been described with a certain degree of particularity, it is understood the disclosure has been made by way of example, and changes in detail or structure made be made without departing from the spirit of the invention as defined in the appended claims.

The invention claimed is:

1. A retractable architectural covering comprising a lift system for raising and lowering the retractable covering including:

a lift cord, a take-up cylindrical spool about which said lift cord can be wrapped, said spool including an external thread in which said lift cord can be wrapped and unwrapped, means for selectively and reversibly rotating said spool, and a follower including an internal thread for receipt on said external thread of said spool whereby said follower is reciprocally movable along the length of said spool as said spool is rotated, a cord slot through which said lift cord extends, and a catch aligned with said cord slot projecting into said external thread of said spool to catch and force said lift cord out of said thread in one predetermined direction of rotation of said spool.

2. The covering of claim 1 wherein said cord slot is an arcuate slot in said follower substantially conforming with the external thread of said spool.

3. The covering of claim 2 wherein said catch is positioned at one end of said cord slot.

4. The covering of claim 1 wherein said internal thread terminates immediately adjacent to said cord passage.

5. The covering of claim 4 wherein said catch is an end of said internal thread.

* * * * *